US009630331B2

(12) United States Patent
Griffin et al.

(10) Patent No.: US 9,630,331 B2
(45) Date of Patent: Apr. 25, 2017

(54) SHAVING SYSTEMS

(71) Applicant: SHAVELOGIC, INC., Dallas, TX (US)

(72) Inventors: John W. Griffin, Moultonborough, NH (US); Craig A. Provost, Boston, MA (US); William E. Tucker, Attleboro, MA (US)

(73) Assignee: SHAVELOGIC, INC., Dallas, TX (US)

( * ) Notice: Subject to any disclaimer, the term of this patent is extended or adjusted under 35 U.S.C. 154(b) by 4 days.

(21) Appl. No.: 14/661,048

(22) Filed: Mar. 18, 2015

(65) Prior Publication Data

US 2015/0190936 A1 Jul. 9, 2015

Related U.S. Application Data

(63) Continuation of application No. PCT/US2013/052107, filed on Jul. 25, 2013.

(60) Provisional application No. 61/706,961, filed on Sep. 28, 2012.

(51) Int. Cl.
*B26B 21/22* (2006.01)
*B26B 21/40* (2006.01)
*B26B 21/52* (2006.01)

(52) U.S. Cl.
CPC ..... *B26B 21/225* (2013.01); *B26B 21/4081* (2013.01); *B26B 21/521* (2013.01)

(58) Field of Classification Search
CPC .. B26B 21/225; B26B 21/521; B26B 21/4081
See application file for complete search history.

(56) References Cited

U.S. PATENT DOCUMENTS 4,094,063 A 6/1978 Trotta
4,403,414 A * 9/1983 Kiraly ..... B26B 21/225 30/531
4,970,784 A 11/1990 Althaus
5,029,391 A * 7/1991 Althaus ..... B26B 21/521 30/533
5,533,263 A * 7/1996 Gilder ..... B26B 21/225 30/527
5,669,139 A * 9/1997 Oldroyd ..... B26B 29/00 30/47

(Continued)

FOREIGN PATENT DOCUMENTS

EP 1245351 10/2002
GB 1 460 732 * 1/1977

(Continued)

OTHER PUBLICATIONS

Search Report—Corresponding European Application No. 13864593, dated Jul. 8, 2016, 7 pages.

*Primary Examiner* — Hwei C Payer
(74) *Attorney, Agent, or Firm* — Leber IP Law

(57) ABSTRACT

Replaceable shaving assemblies are disclosed that include a blade unit, an interface element configured to removeably connect the blade unit to a handle, on which the blade unit is pivotably mounted, and a return element disposed on the interface element. Shaving systems including such shaving assemblies are also disclosed, as are methods of using such shaving systems.

16 Claims, 15 Drawing Sheets

(56) References Cited

U.S. PATENT DOCUMENTS

| | | | | |
|---|---|---|---|---|
| 5,678,316 | A * | 10/1997 | Althaus | B26B 21/528 30/340 |
| 6,112,412 | A | 9/2000 | Richard | |
| 6,122,826 | A † | 9/2000 | Coffin | |
| 6,223,442 | B1 † | 5/2001 | Pina | |
| 6,311,400 | B1 † | 11/2001 | Hawes | |
| 6,615,498 | B1 * | 9/2003 | King | B26B 21/225 30/527 |
| 6,880,253 | B1 | 4/2005 | Gyllerstrom | |
| 6,973,730 | B2 | 12/2005 | Tomassetti | |
| 6,990,740 | B2 * | 1/2006 | Follo | B26B 21/521 30/527 |
| 7,028,405 | B2 | 4/2006 | Paas et al. | |
| 7,086,160 | B2 | 8/2006 | Coffin | |
| 7,100,284 | B2 | 9/2006 | King | |
| 7,103,976 | B2 | 9/2006 | Pennella | |
| 7,152,512 | B1 | 12/2006 | Prochaska | |
| 7,200,942 | B2 | 4/2007 | Richard | |
| 7,461,458 | B2 | 12/2008 | Peyser | |
| 7,526,869 | B2 | 5/2009 | Blatter | |
| 7,574,809 | B2 | 8/2009 | Follo | |
| 7,669,511 | B2 | 3/2010 | King | |
| 7,797,834 | B2 | 9/2010 | Steunenberg | |
| 7,877,879 | B2 | 2/2011 | Nakasuka | |
| 8,033,023 | B2 | 10/2011 | Johnson | |
| 8,096,054 | B2 † | 1/2012 | Denkert | |
| 8,166,661 | B2 | 5/2012 | King | |
| 8,205,343 | B2 | 6/2012 | Winter et al. | |
| 8,205,344 | B2 | 6/2012 | Stevens | |
| 8,273,205 | B2 † | 9/2012 | Murgida | |
| 8,307,552 | B1 | 11/2012 | Drouillard | |
| 8,484,852 | B2 | 7/2013 | King | |
| 8,590,162 | B2 | 11/2013 | Park et al. | |
| 8,640,342 | B2 | 2/2014 | Murgida | |
| 9,283,685 | B2 * | 3/2016 | Griffin | B26B 21/521 |
| 2002/0138992 | A1 * | 10/2002 | Richard | B26B 21/225 30/527 |
| 2006/0037197 | A1 * | 2/2006 | Hawes | B26B 19/3806 30/45 |
| 2006/0080838 | A1 * | 4/2006 | Johnson | B26B 21/222 30/50 |
| 2010/0043242 | A1 * | 2/2010 | Stevens | B26B 21/521 30/527 |
| 2011/0247217 | A1 | 10/2011 | Johnson et al. | |
| 2012/0297625 | A1 | 11/2012 | Madden | |
| 2014/0083265 | A1 * | 3/2014 | Provost | B26B 21/225 83/13 |
| 2014/0109735 | A1 * | 4/2014 | Shepperson | B26B 21/521 83/13 |
| 2014/0165800 | A1 * | 6/2014 | Griffin | B26B 21/225 83/13 |
| 2015/0158192 | A1 * | 6/2015 | Tucker | B26B 21/225 83/13 |
| 2015/0174776 | A1 * | 6/2015 | Hawes | B26B 21/14 30/526 |
| 2015/0190935 | A1 * | 7/2015 | Griffin | B26B 21/225 132/200 |
| 2015/0190936 | A1 * | 7/2015 | Griffin | B26B 21/225 132/200 |
| 2015/0290819 | A1 * | 10/2015 | Giannopoulos | B26B 21/222 30/532 |
| 2015/0306777 | A1 * | 10/2015 | Georgakis | B26B 21/222 30/57 |
| 2015/0314465 | A1 * | 11/2015 | Giannopoulos | B26B 21/222 30/532 |
| 2015/0314466 | A1 * | 11/2015 | Papadopoulos-Papageorgis | B26B 21/222 30/532 |
| 2015/0321366 | A1 * | 11/2015 | Papadopoulos-Papageorgis | B26B 21/222 30/532 |

FOREIGN PATENT DOCUMENTS

| | | |
|---|---|---|
| WO | 2012158143 | 11/2012 |
| WO | 2014051843 | 4/2014 |

* cited by examiner
† cited by third party

SHAVING SYSTEMS

RELATED APPLICATIONS

This application is a continuation application of PCT Application Ser. No. PCT/US2013/052107, filed Jul. 25, 2013 which claims priority of U.S. Provisional Application Ser. No. 61/706,961, filed on Sep. 28, 2012. The complete disclosure of each of these applications is hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

Embodiments of the present invention generally provide a reusable shaving system including a replaceable shaving assembly having a pivoting blade unit, and a reusable handle on which the shaving assembly is removeably mounted.

In one aspect, the invention features a replaceable shaving assembly that includes a blade unit; an interface element configured to removeably connect the blade unit to a handle, on which the blade unit is pivotably mounted; and a return element disposed on the interface element.

Some implementations include one or more of the following features.

The blade unit may be pivotably mounted on the interface element by the positioning of a pair of fingers, which extend from the interface element, in receiving bores or clips disposed on the blade unit. Pivoting of the blade unit is generally about an axis that is generally parallel to the long axis of the blade unit.

The return element may be formed of or include an elastomer, e.g., a thermoplastic elastomer or thermoplastic urethane.

The return element may be configured to interact with a corresponding structure on the blade unit, e.g., a clip disposed on the blade unit under which the return element is positioned, so as to provide a return force.

In some cases, the return element is in the form of two bands positioned adjacent to and inboard of the fingers, in which case the corresponding structure on the blade unit includes a pair of clips, under which the return elements are positioned. Alternatively, the return element may be in the form of a single band positioned generally centrally along the length of the interface element.

In some cases, the return element is supported and spaced from the main surface of the interface element by support elements that extend generally perpendicularly to a long axis of the interface element.

Preferably, the blade unit is mounted directly on the interface element, without any intervening structures that are not integral with the blade unit.

In another aspect, the invention features a shaving system that includes a handle having a distal end and a proximal end; and a replaceable shaving assembly that includes a blade unit, an interface element configured to removeably connect the blade unit to a handle, on which the blade unit is pivotably mounted, and a return element disposed on the interface element.

This shaving system may include any of the features disclosed above or elsewhere herein.

In yet a further aspect, the invention features a method of shaving comprising contacting the skin with the blade unit of a shaving system comprising a handle having a distal end and a proximal end, and a replaceable shaving assembly that includes a blade unit, an interface element configured to removeably connect the blade unit to a handle, on which the blade unit is pivotably mounted, and a return disposed on the interface element.

Advantageously, in some implementations the return element of the shaving systems disclosed herein eliminates the need for a "pusher/follower" razor construction to provide a force to supply resistance during shaving and return the blade unit to a "rest" portion when not in contact with the user's skin.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit, which includes an elastomeric return element. For example, the shaving systems disclosed herein include an interface element that provides a removable attachment between the handle and blade unit, and that includes one or more elongated elastomeric members that provide the resistance and return force usually supplied by a pusher/follower assembly.

Figure 1:
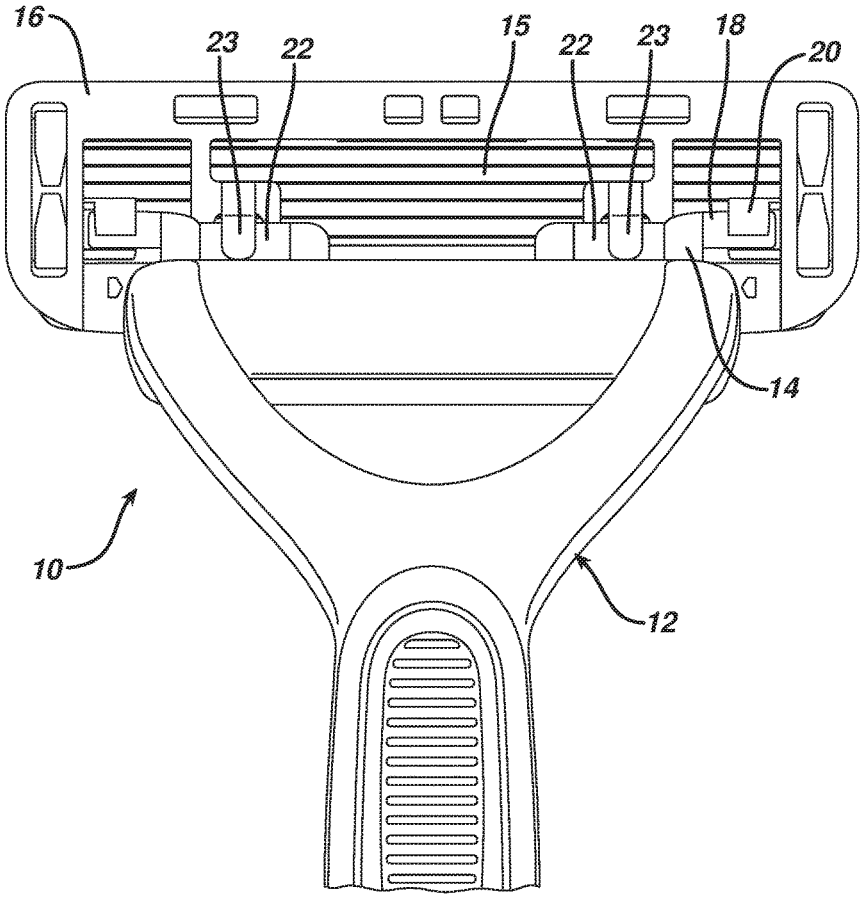
FIG. 1 is a rear plan view of a shaving system according to one embodiment of the invention.

FIG. 1 shows a shaving system 10 that includes a handle 12, interface element 14 (FIG. 2), and blade unit 16, which includes a plurality of blades 15. Blade unit 16 is pivotably mounted on interface element 14 by the positioning of a pair of fingers 18, which extend from the interface element, in receiving bores or clips 20 which may be molded integrally with the blade unit 16 or part of a separate connector snapped onto the blade unit. Pivoting of the blade unit is about an axis that is generally parallel to the long axis of the blade unit and is generally positioned to allow the blade unit to follow the contours of a user's skin during shaving.

Figure 14A:
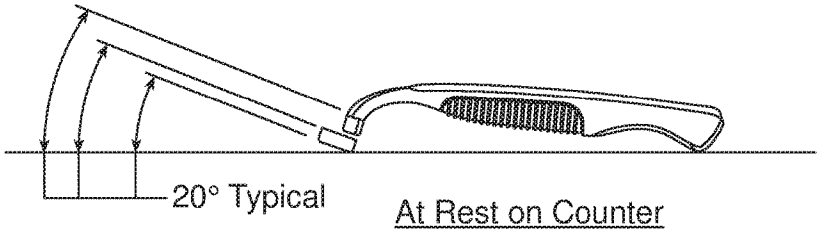
FIGS. 14A and B are diagrammatic views illustrating how the angle of the blade unit with respect to the handle at rest, and to the skin surface during shaving, is measured.
Figure 14B:
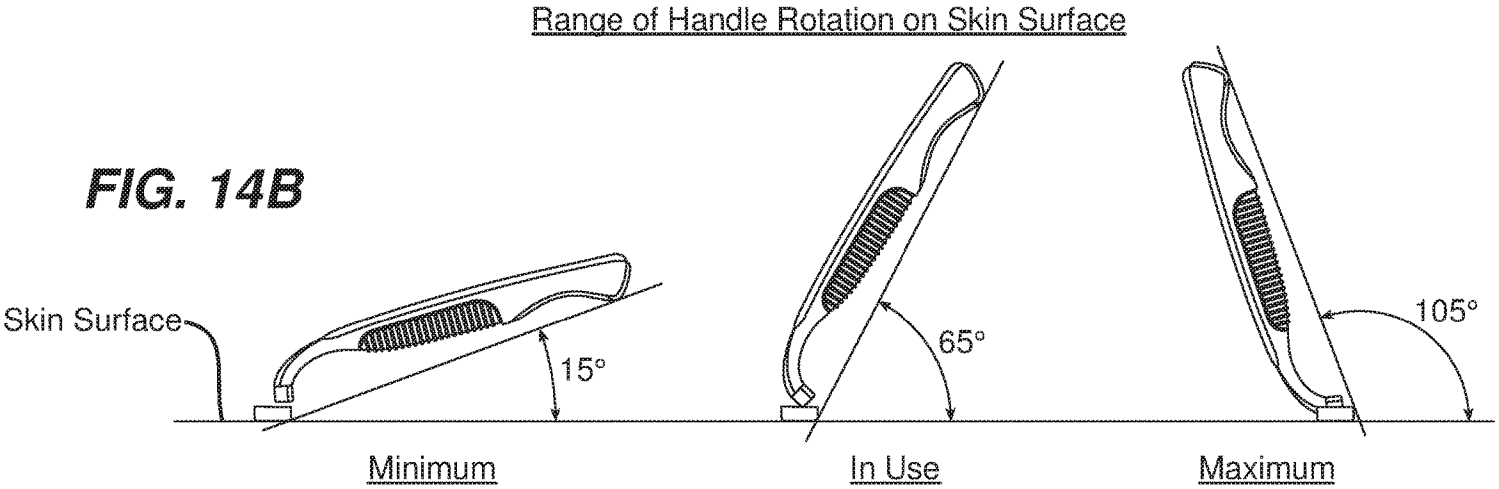

Referring to FIGS. 14A and 14B, the angle of blade unit 16 with respect to handle 12 is about 15° at rest, and the angle of the blade unit with respect to the skin surface can range from approximately 15° to 105° during shaving. The handle 12 provides a manner in which the shaving system can be manipulated and leverage can be applied to achieve desired shaving results.

Figure 2:
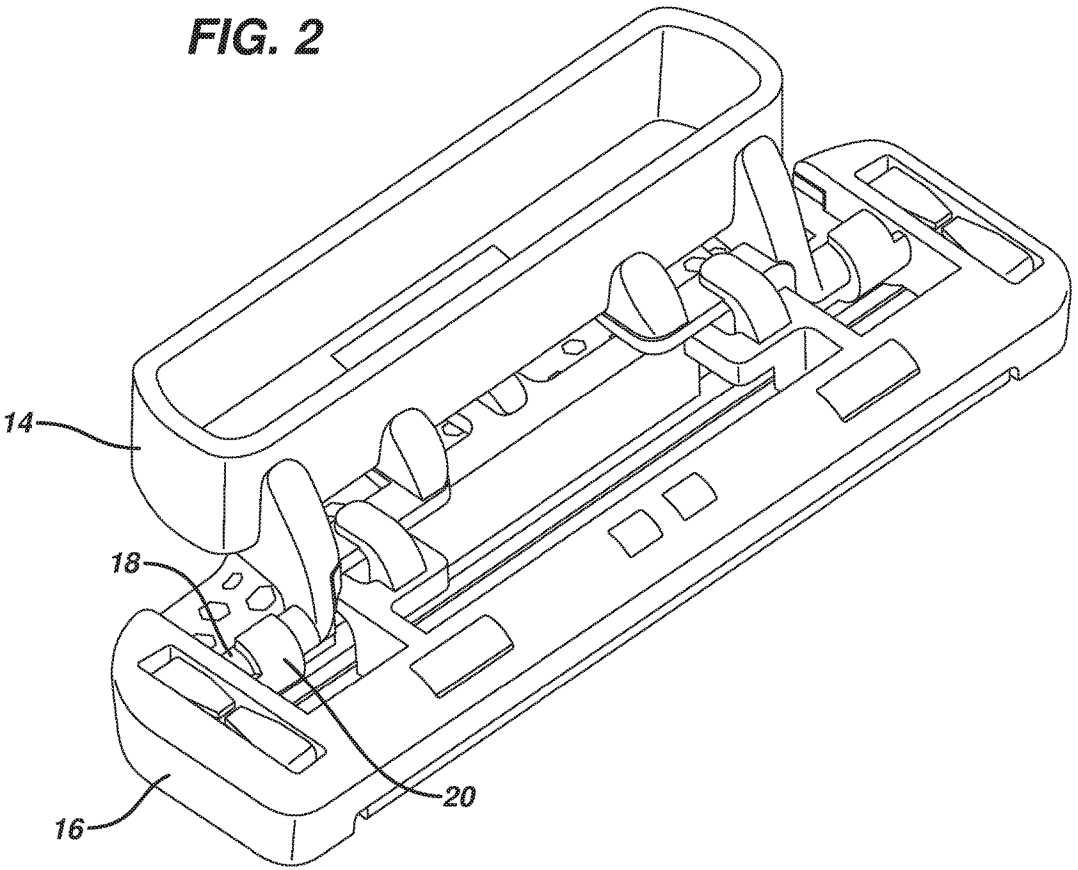
FIG. 2 is perspective view of the shaving assembly portion of the shaving system shown in FIG. 1.

Generally, the interface element 14 and blade unit 16 are sold to the consumer as an integrated replaceable shaving assembly. FIG. 2 shows the replaceable shaving assembly, including the blade unit and interface element, as it would be viewed when attaching the shaving assembly to a handle.

In this implementation, the return force is provided by a return element in the form of a pair of elongated resilient bands 22. Bands 22 are disposed on the interface element, inboard of the fingers 18, and are positioned to fit under a pair of clips 23 on the blade unit. The interaction of these bands with the clips 23 provides resistance during shaving, limiting the free pivoting of the blade unit about the pivot axis described above, and providing a return force that biases the blade unit towards its rest position, in the same manner that resistance and return are typically provided by a pusher/follower assembly.

The integration of the return element (bands 22) with the interface unit 14, and the relatively small profile of the fingers 18 and clips 20, provides a shaving assembly with very good rinsability. As shown in FIG. 1, almost the entire area behind the blades 15 is open, allowing debris to be readily rinsed out of the blade unit during use. For example, less than 20%, less than 10% or even less than 5% of the area behind the blades may be unobstructed in preferred embodiments.

Figure 3A:
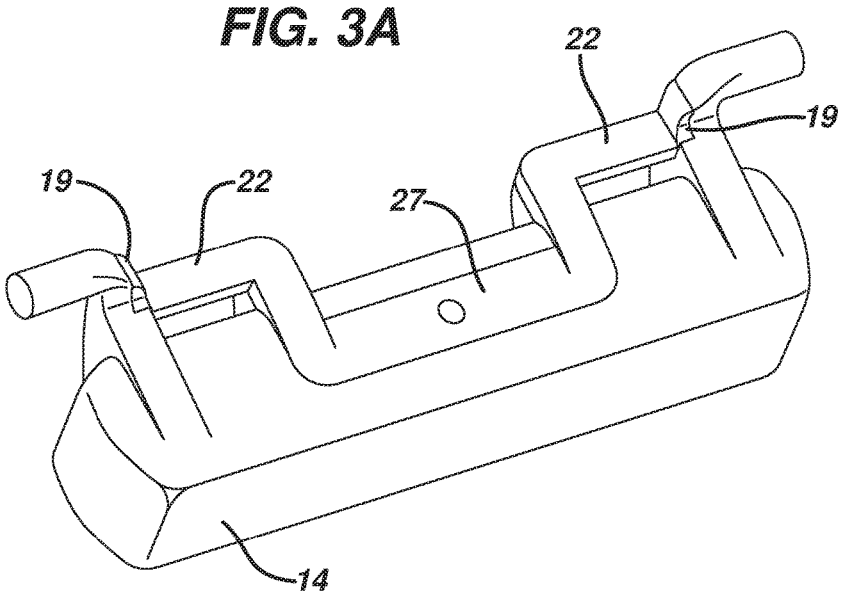
FIGS. 3A and 3B are perspective views from different directions of the interface element of the shaving assembly shown in FIG. 2.

Referring to FIG. 3A the two bands 22 can be integrally molded as part of a single elastomeric return element 27. This arrangement allows the return element to be molded via a central opening in the interface piece, and provides good anchoring of the elastomer on the interface element. Anchoring is also provided by side portions 19 of the bands 22, which are molded into corresponding underlying recesses (not shown) in the interface element.

Figure 3B:
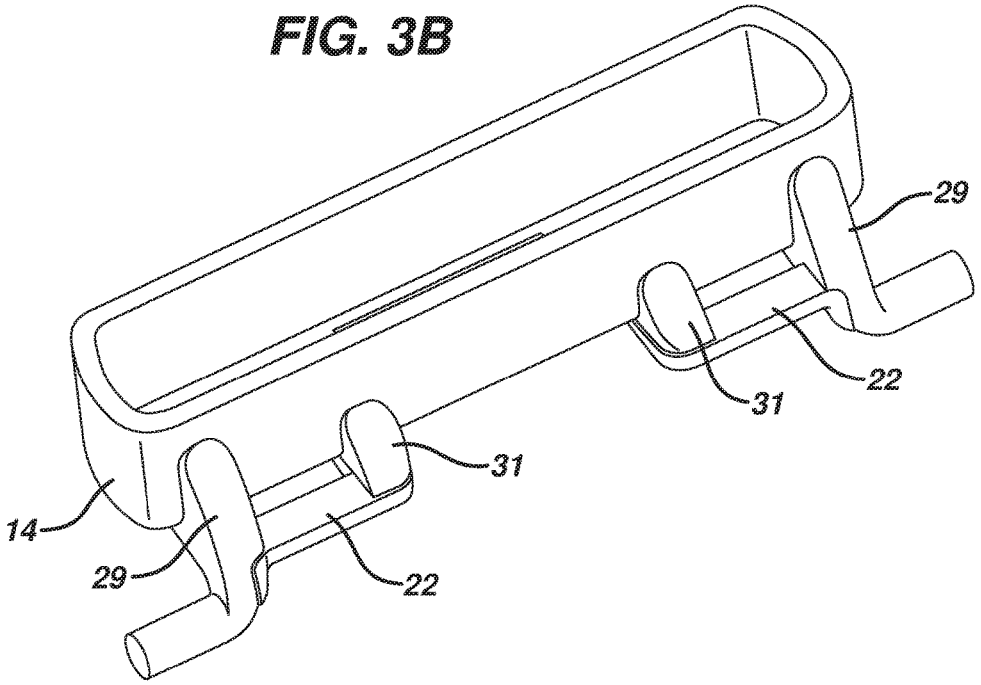

Referring to FIG. 3B, the bands 22 are each supported on the outboard side by an arm 29 from which the pin 18 extends and on the inboard side by a support 31. This support allows the bands 22 to effectively provide an opposing force to that of the clips 23, and prevents detachment of the bands 22 during the life of the product.

The return element can be formed, for example, from synthetic or natural rubber materials. Suitable materials include, for example, polyether-based thermoplastic elastomers (TPEs) available from Kraiburg HTP, thermoplastic urethanes (TPUs), silicones, and polyether-based thermoplastic vulcanizate elastomer (TPVs) available from GLS PolyOne Corporation under the tradename Santoprene™ The elastomeric material is selected to provide a desired degree of restoring force and durability. In some implementations, the elastomer has a Durometer of less than about 45 Shore A, e.g., from about 20 to 90 Shore A.

The bands 22 are pretensioned by a stretching of the bands that exists when the blade unit is in its at rest position. Pretensioning provides a resistance force so that a load is applied as soon as the user starts shaving, balancing the razor. The return element is generally designed such that its geometry provides an applied load as assembled that is sufficient to overcome the friction of the system at rest (pretensioned load), typically at least 5 grams, e.g., 5 to 15 grams, and a load during shaving of from about 5 to 100 grams, e.g., 10 to 50 grams.

Figure 4:
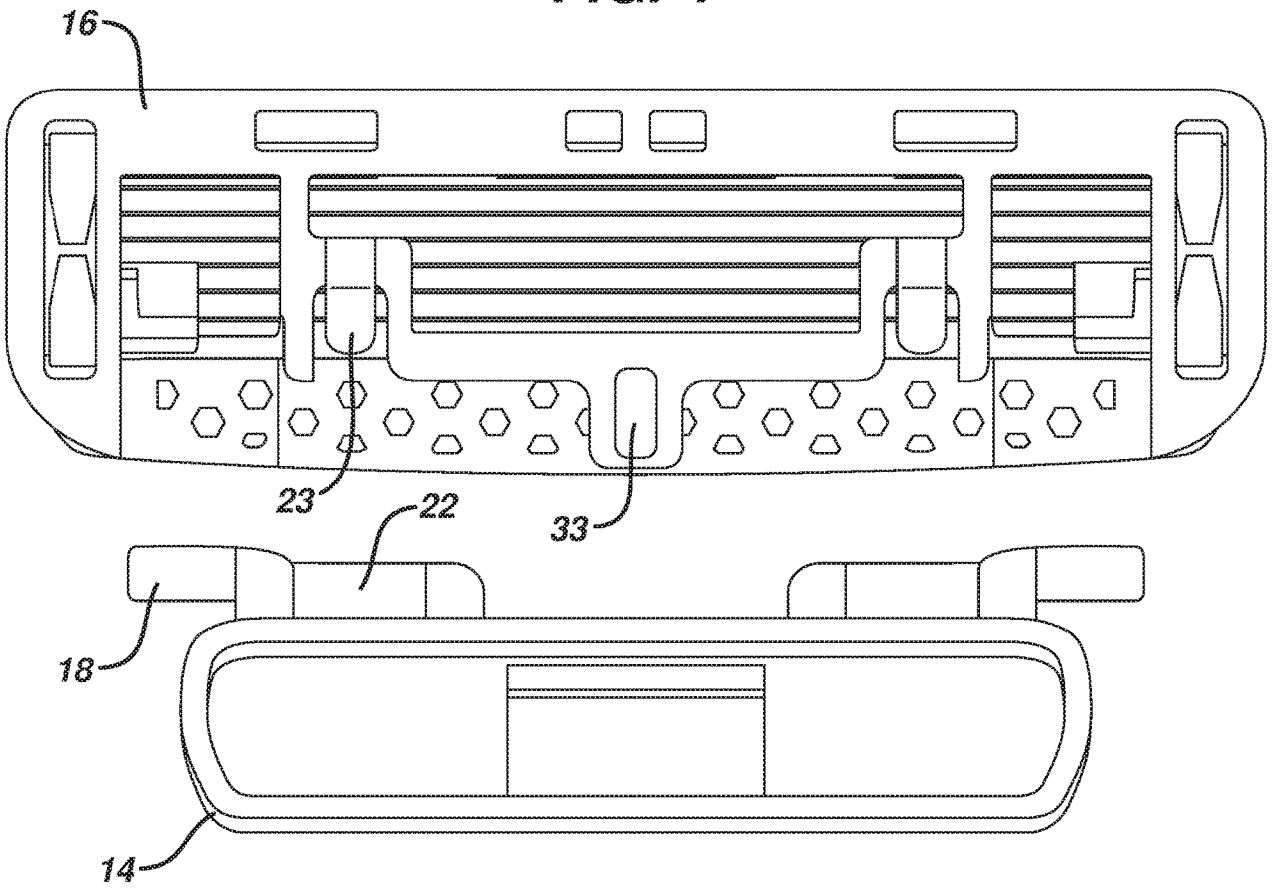
FIGS. 4, 5A and 5B are exploded views of the shaving assembly, showing the interface element separated from the blade unit.
Figure 5A:
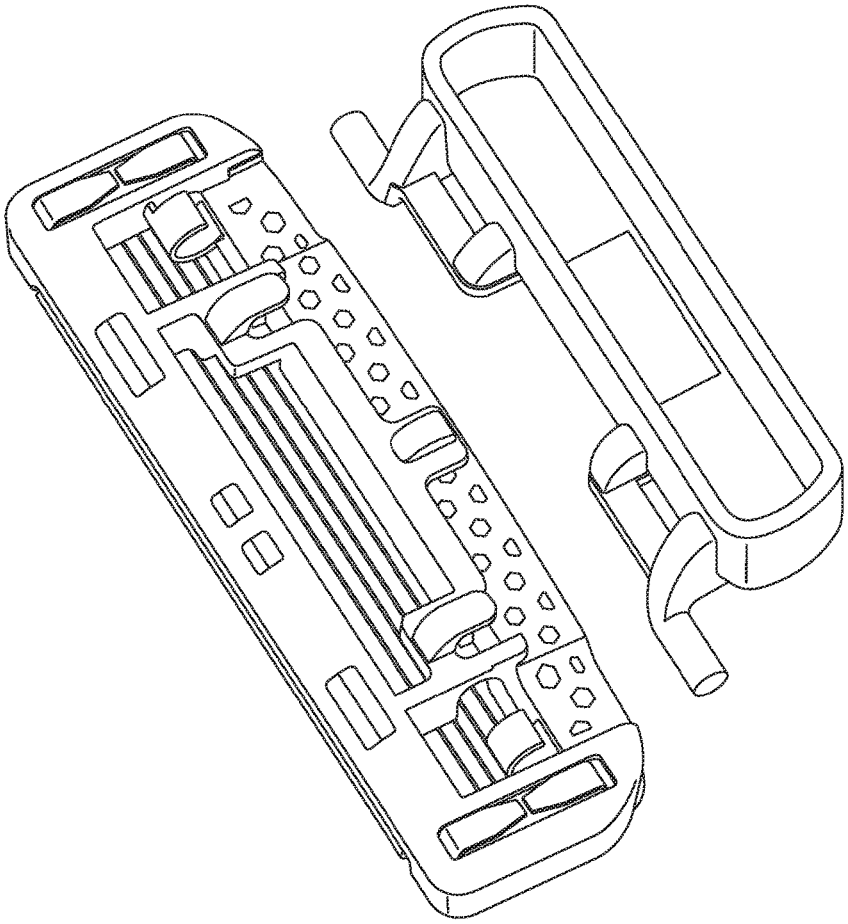
Figure 5B:
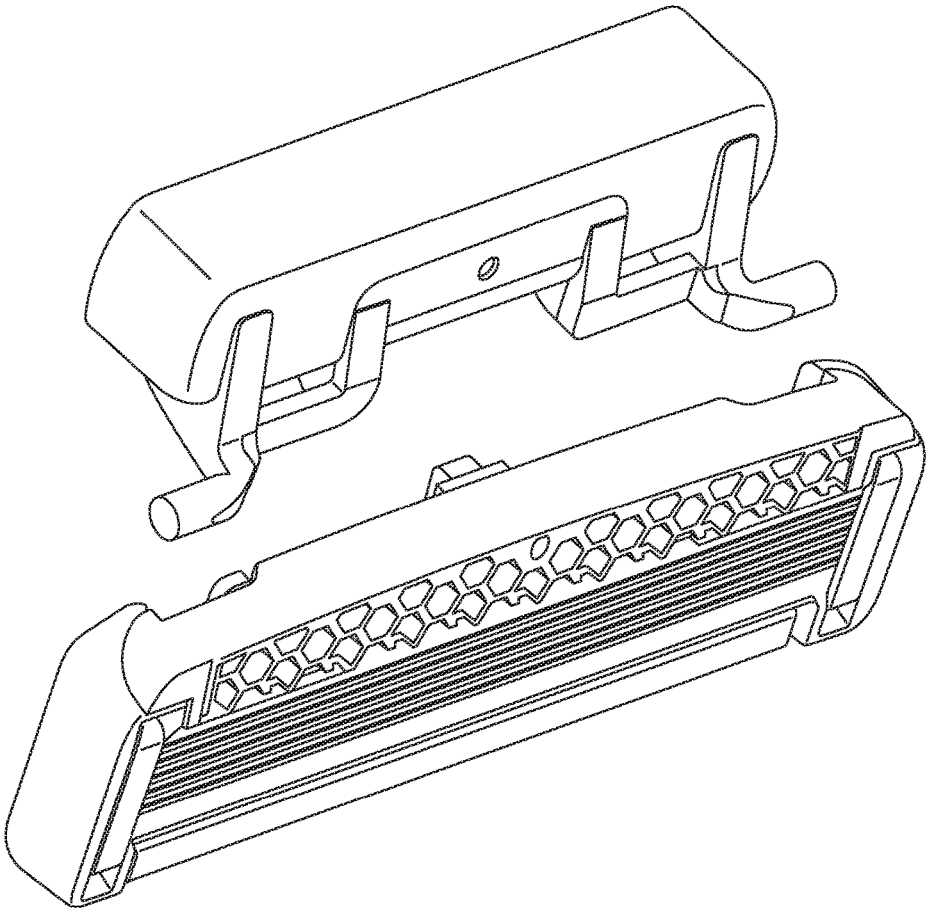
Figure 6:
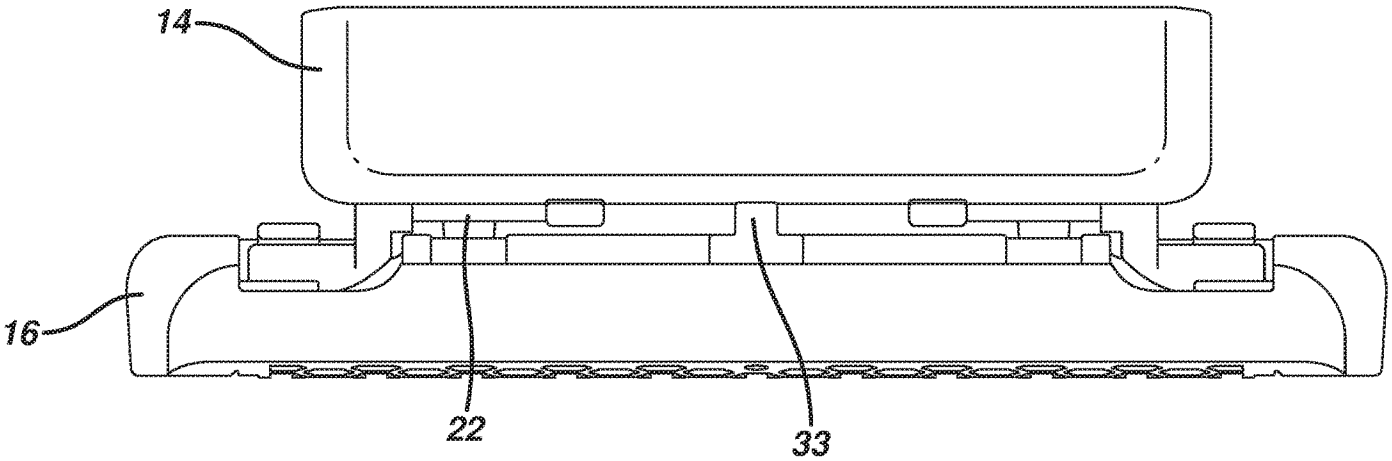
FIG. 6 is a rear elevational view of the shaving assembly of FIG. 2.
Figure 7:
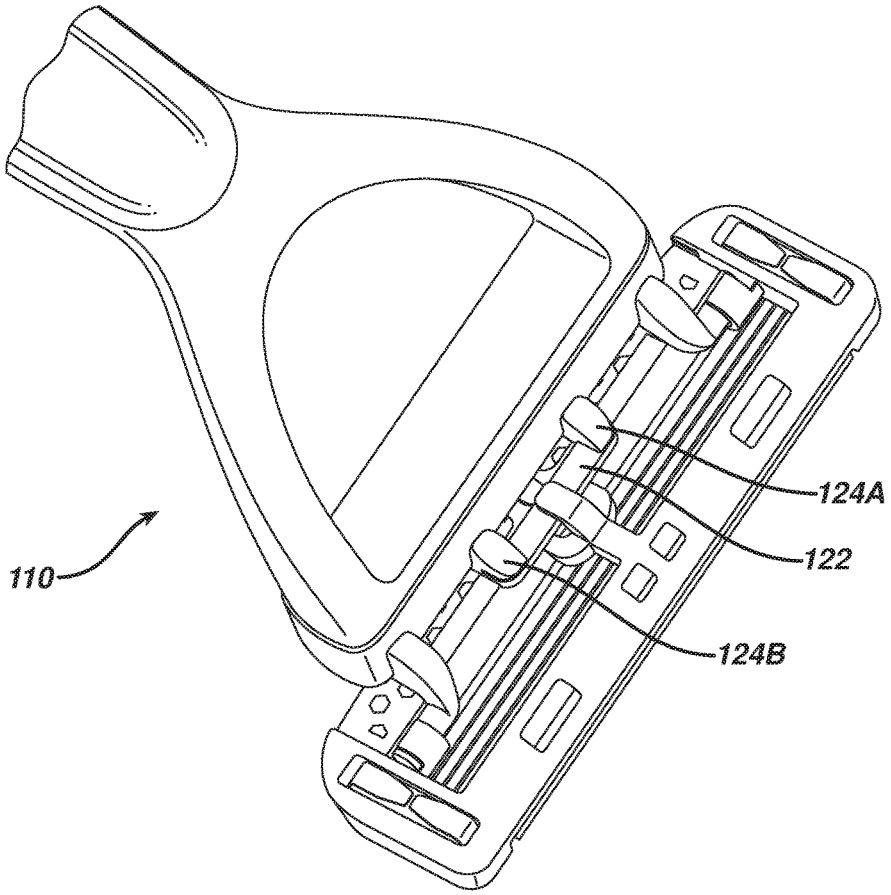
FIG. 7 is a perspective view of a shaving system according to an alternative embodiment.
Figure 8:
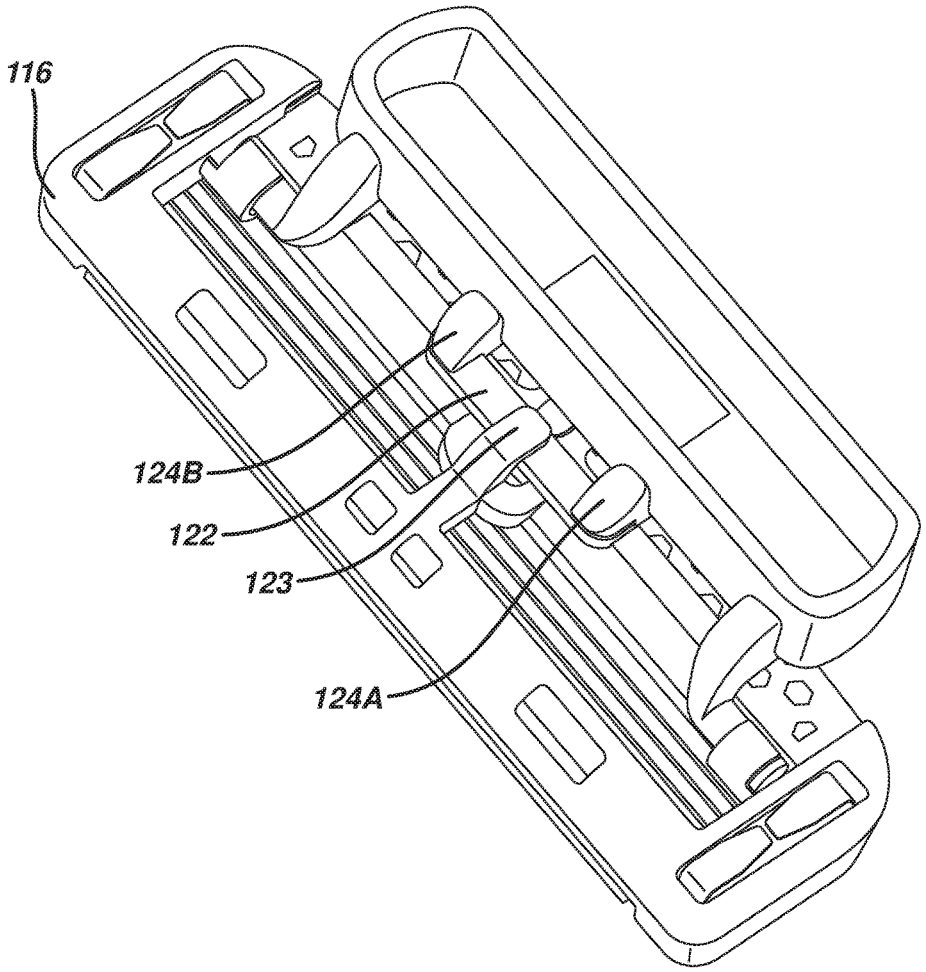
FIG. 8 is a perspective view of the shaving assembly portion of the shaving system shown in FIG. 7.
Figure 9A:
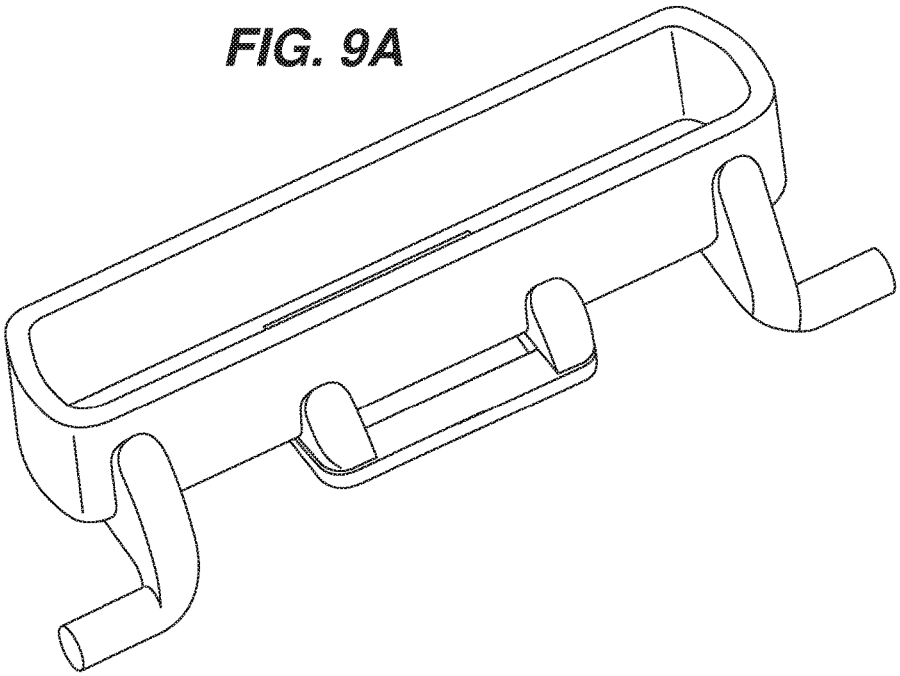
FIGS. 9A and 9B are perspective views from different directions of the interface element of the shaving assembly shown in FIG. 8.
Figure 9B:
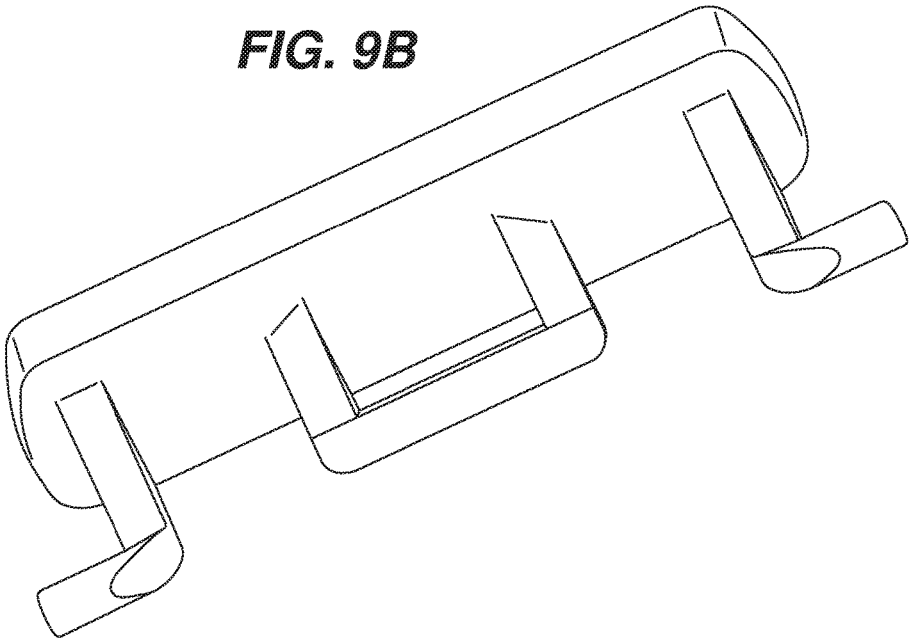

Exploded views of the shaving system are shown in FIGS. 4-5B, illustrating the manner in which the interface element and blade unit are aligned for assembly into a completed shaving assembly. FIGS. 4 and 6 also show pivot stop 33 on the blade unit, which is integrally formed with the blade unit and which limits the pivoting of the blade unit.

Figure 10:
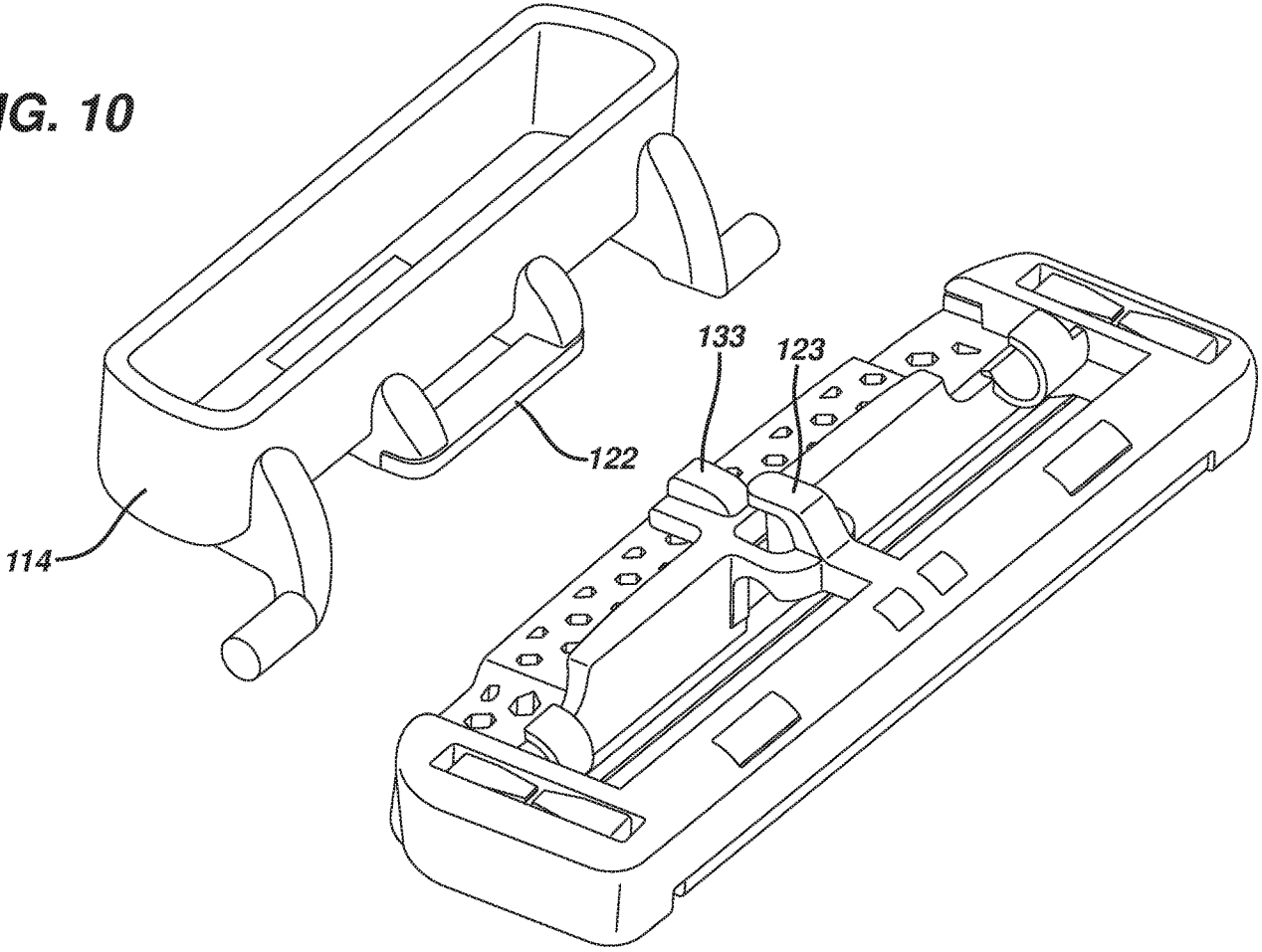
FIGS. 10-12 are exploded views of the shaving assembly, showing the interface element separated from the blade unit.
Figure 11:
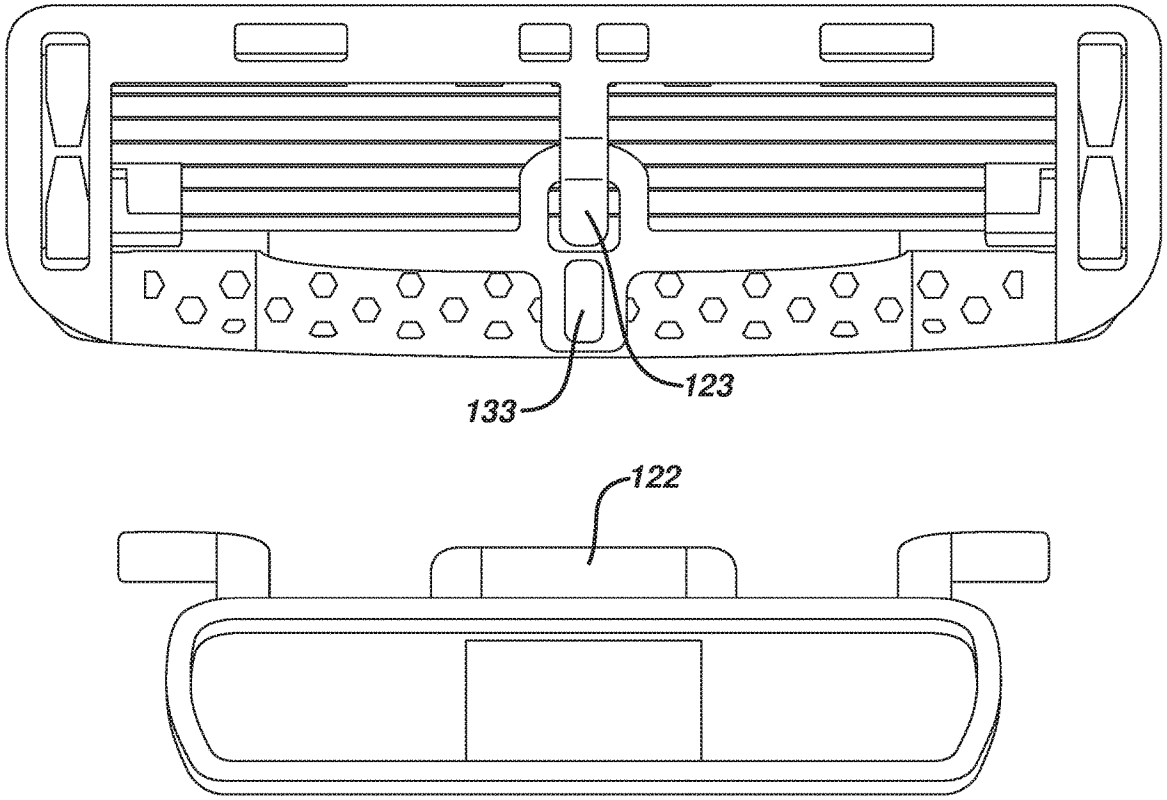
Figure 12:
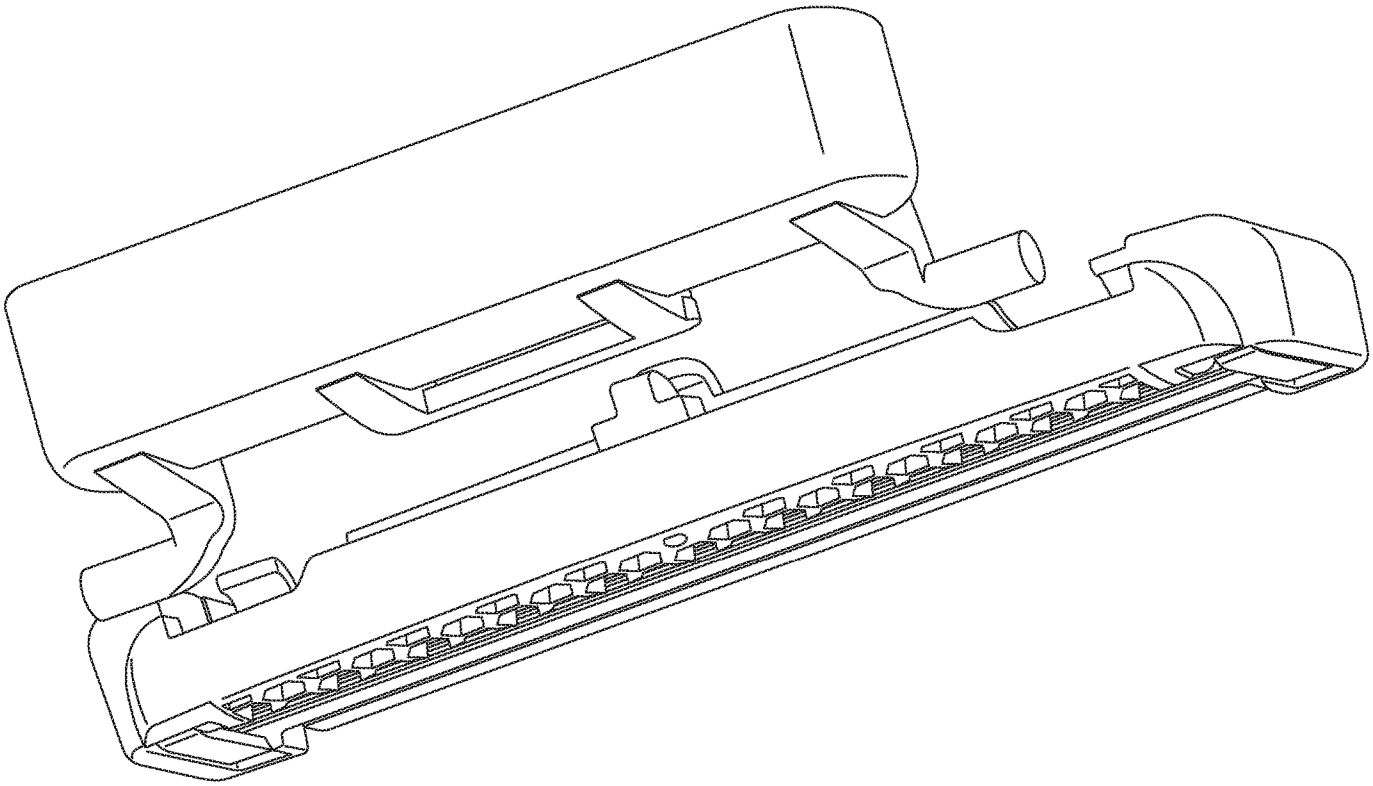
Figure 13:
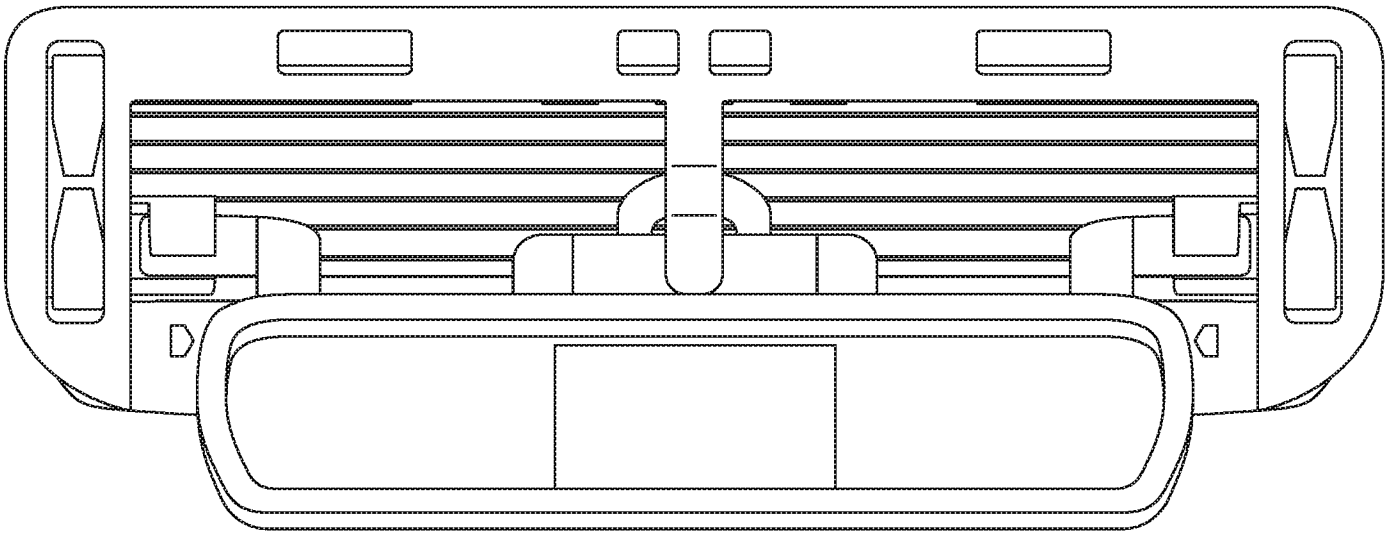
FIG. 13 is a rear plan view of the shaving assembly shown in FIG. 8.

FIGS. 7-13 show a shaving system 110 according to an alternate embodiment. This embodiment is similar to the one discussed above, except that instead of two return elements 22, the interface element includes a single return element 122. Return element 122 is mounted generally centrally along the length of the interface unit 114, and is supported by and spaced from the surface of the interface unit by a pair of support members 124A, 124B. In this case, the blade unit 116 includes a single, central clip 123, which engages the return element 122 in the same manner that clips 23 engage return elements 22 in the embodiment discussed above. Central clip 123 is positioned adjacent to pivot stop 133, as shown in FIGS. 10 and 11.

A number of embodiments have been described. Nevertheless, it will be understood that various modifications may be made without departing from the spirit and scope of the disclosure.

For example, in some implementations the shaving assembly could include three or more return elements and corresponding clips, for example the interface element could include both a central return element and a pair of return elements positioned adjacent the fingers.

Moreover, instead of being positioned over bands 22, as shown, clips 23 can be positioned in other manners relative to the bands, e.g., may extend through the bands.

As a further example, the pivoting mechanism may be different. For example, the fingers may be replaced by other types of protrusions, such as spherical members, or the entire pivoting mechanism may be replaced by a different type of pivot. Also, the pivoting mechanism may be positioned differently with respect to the bands or other return elements, e.g., in the embodiment shown in FIG. 1 the fingers could be moved inboard of the bands, and could face towards each other, and the clips or bores engaged by the fingers relocated correspondingly.

Accordingly, other embodiments are within the scope of the following claims.

What is claimed is:

1. A shaving system comprising:

a handle having a distal end and a proximal end; and mounted on the handle, a replaceable shaving assembly that includes a blade unit having a rear surface and one or more clip member(s) extending from the rear surface, an interface element configured to removeably connect the blade unit to the handle, on which the blade unit is pivotably mounted, and an elastomeric return element disposed on the interface element, the return element comprising one or more elongated band(s) of elastomer, the band(s) having a longitudinal axis extending generally parallel to a longitudinal axis of the blade unit, wherein the clip member(s) extend over and interact with the band(s).

2. The shaving system of claim 1 wherein the blade unit is pivotably mounted on the interface element by the positioning of a pair of fingers, which extend from the interface element, in receiving bores or clips disposed on the blade unit.

3. The shaving system of claim 2 wherein the return element is in the form of two bands positioned adjacent to and inboard of the fingers.

4. The shaving system of claim 3 wherein the blade unit includes two of the clip members, under which the two bands are positioned.

5. The shaving system of claim 1 wherein pivoting of the blade unit is about an axis that is generally parallel to the longitudinal axis of the blade unit.

6. The shaving system of claim 1 wherein the return element is in the form of a single band positioned generally centrally along the length of the interface element.

7. The shaving system of claim 1 wherein the blade unit is mounted directly on the interface element.

8. The shaving system of claim 1 wherein the return element is supported and spaced from a surface of the interface element that extends generally parallel to the longitudinal axis of the band(s) by support elements that extend generally perpendicularly to a long axis of the interface element.

9. A replaceable shaving assembly comprising:

a blade unit having a rear surface and one or more clip member(s) extending from the rear surface;

an interface element configured to removeably connect the blade unit to a handle, on which the blade unit is pivotably mounted; and an elastomeric return element disposed on the interface element, the return element comprising one or more elongated band(s) of elastomer, the band(s) having a longitudinal axis extending generally parallel to a longitudinal axis of the blade unit;

wherein the clip member(s) extend over and interact with the band(s).

10. The shaving assembly of claim 9 wherein the blade unit is pivotably mounted on the interface element by the positioning of a pair of fingers, which extend from the interface element, in receiving bores or clips disposed on the blade unit.

11. The shaving assembly of claim 10 wherein the return element is in the form of two bands positioned adjacent to and inboard of the fingers.

12. The shaving assembly of claim 11 wherein the blade unit includes two of the clip members, under which the two bands are positioned.

13. The shaving assembly of claim 9 wherein pivoting of the blade unit is about an axis that is generally parallel to the longitudinal axis of the blade unit.

14. The shaving assembly of claim 9 wherein the return element is in the form of a single band positioned generally centrally along the length of the interface element.

15. The shaving assembly of claim 9 wherein the blade unit is mounted directly on the interface element.

16. The shaving assembly of claim 9 wherein the return element is supported and spaced from a surface of the interface element that extends generally parallel to the longitudinal axis of the band(s) by support elements that extend generally perpendicularly to a long axis of the interface element.

* * * * *